US011054098B1

(12) United States Patent
Lu

(10) Patent No.: US 11,054,098 B1
(45) Date of Patent: Jul. 6, 2021

(54) KNOCK-DOWN CHANDELIER

(71) Applicant: Revel Home, Chino, CA (US)

(72) Inventor: Kenneth Lu, Chino, CA (US)

(73) Assignee: REVEL HOME, Chino, CA (US)

( * ) Notice: Subject to any disclaimer, the term of this patent is extended or adjusted under 35 U.S.C. 154(b) by 0 days.

(21) Appl. No.: 16/936,341

(22) Filed: Jul. 22, 2020

(51) Int. Cl.
*F21S 8/06* (2006.01)
*F21V 17/00* (2006.01)

(52) U.S. Cl.
CPC ..... *F21S 8/065* (2013.01); *F21V 17/007* (2013.01)

(58) Field of Classification Search
CPC .... F21S 8/06; F21S 8/061; F21S 8/063; F21S 8/065; F21Y 2103/33; F21V 21/008; F21V 17/007
See application file for complete search history.

(56) References Cited

U.S. PATENT DOCUMENTS 2,195,154 A * 3/1940 Scott ..... F21S 8/06 362/225
6,371,632 B1 * 4/2002 Lavy ..... F21S 8/065 206/320
6,769,785 B1 * 8/2004 Herst ..... F21V 21/00 174/63
6,827,603 B1 * 12/2004 Lin ..... F21S 8/065 362/406
6,945,806 B1 * 9/2005 Hsieh ..... F21S 8/065 362/405
7,506,994 B1 * 3/2009 Waycaster ..... F21S 2/00 362/225
8,714,775 B2 * 5/2014 Bracher ..... F21V 5/06 362/249.01
10,161,601 B1 * 12/2018 Chen ..... F21V 17/007
10,473,281 B1 * 11/2019 Sonneman ..... F21V 23/003
2002/0145877 A1 * 10/2002 Johnson ..... F21S 8/065 362/406
2005/0047150 A1 * 3/2005 Hsieh ..... F21V 17/007 362/404
2005/0061532 A1 * 3/2005 Hsieh ..... F21V 17/007 174/650
2006/0203501 A1 * 9/2006 Chen ..... F21V 21/16 362/405
2015/0300605 A1 * 10/2015 Clark ..... B29C 65/48 362/367
2016/0018588 A1 * 1/2016 Parker ..... F21S 8/066 362/613
2018/0039014 A1 * 2/2018 Ju ..... F21V 23/02
2019/0064426 A1 * 2/2019 Ju ..... F21V 23/06
2019/0339443 A1 * 11/2019 Ross ..... F21V 23/002
2020/0300447 A1 * 9/2020 Luo ..... A01G 9/249

* cited by examiner

*Primary Examiner* — Alexander K Garlen

(57) ABSTRACT

A knock-down chandelier is separable into a plurality of partial assemblies and components. Each partial assembly includes a frame part having a channel therein, a light mount coupled to the frame part and configured for holding a lighting element, a connecting arm rotatably coupled to the frame part and having a channel therein, and wiring electrically connected to the light mount and extending from the light mount through the channels of the frame part and the connecting arm. The chandelier also includes a linking structure configured for connecting the frame part of one partial assembly to the frame part of another partial assembly.

20 Claims, 4 Drawing Sheets

KNOCK-DOWN CHANDELIER

TECHNICAL FIELD

The present disclosure relates to the fields of luminaires, and particularly to a chandelier that can be knocked-down resulting in reduced packaging dimensions.

BACKGROUND

Chandeliers are customarily grand ornamental light fixtures mounted on the ceiling of a large room to provide ambient lighting and elevate the style of the room. Chandeliers range in size and style to fit most decorating designs and home styles but are typically larger than most other lighting for filling large spaces. However, packaging and transporting chandeliers often require larger packaging to box the entire chandelier, thereby making the packaged chandelier large and unwieldy, and subject to higher shipping rates and import duties.

SUMMARY

The present disclosure presents embodiments of luminaires that can be disassembled into smaller partial assemblies and components for convenient packaging and reduced shipping costs. Some of the smaller partial assemblies and components of the luminaire may be designed to fold into itself to form a more compact structure. The luminaire can include two or more partial assemblies that can be packaged and shipped together into a single smaller package than when fully assembled. The two or more partial assemblies, when combined, form a complete luminaire. Each partial assembly can comprise a frame part which when coupled with the other frame part of the one or more other partial assemblies, form a complete frame, which can be an enclosed frame or open frame. Each frame part can be hollow for providing a raceway for wires to feed to one or more light mounts mounted directly or indirectly to the frame part. The wires are electrically connected to an electrical box located on the wall or ceiling. The frame parts can be connected by a linking mechanism or linking structure either built into the frame part or as a separate component used to couple the frame parts together during assembly of the luminaire. In one aspect, through holes are provided at the ends of each frame part for the linking structure.

The enclosed frame, via connecting arms, can be hung from a ceiling canopy connected to the electrical box in the ceiling. The partial assembly can include one or more connecting arms rotatably coupled to a frame part. The connecting arms can be hollow and open on both ends for providing a raceway for wires. The wires extend from the electrical box, through a hole in the ceiling canopy, the raceway of the connecting arm, a hole in a side of the frame part, and the raceway of the frame part to the light mounts for providing power to lighting elements connected to the light mounts. Typically, the wires run in parallel so that if one lighting element goes out, it does not open the circuit and the other lighting elements can remain on. The light mount itself may be a lighting element such as an LED element. Each connecting arm can be rotatably coupled to the frame part so that the connecting arm can be disposed within an interior space or perimeter of the frame arm to form a compact packing structure in its collapsed state. In the collapsed state, the connecting arm can be directly joined to the frame part or indirectly joined to the frame part by the wires.

When assembling the luminaire, the partial assemblies can be removed from the packaging and the frame parts can be joined together by the linking structure. One end of the connecting arms can be connected to the frame part, if not already connected, and the other end of the connecting arm can be attached to the ceiling canopy. When fully assembled, the luminaire comprised of frame parts and light mounts and other components hangs below the ceiling canopy by the connecting arms.

The luminaire can hang lower from the ceiling by adding stems and a lower canopy. The lower canopy will then be connected to the connecting arms rather than the ceiling canopy.

BRIEF DESCRIPTION OF THE DRAWINGS

In order to describe the embodiments of the present disclosure or the technical solutions in the prior art more clearly, accompanying drawings required for descriptions of the embodiments or the prior art will be briefly introduced below. Apparently, the accompanying drawings in the following descriptions are merely several exemplary embodiments of the present disclosure. Those skilled in the art can obtain other drawings according to the disclosed accompanying drawings without any creative work.

DETAILED DESCRIPTION

The technical solutions of the embodiments of the present disclosure will be described clearly and completely in combination with the accompanying drawings in the embodiments of the present disclosure. Apparently, the described embodiments are merely part of embodiments of the present disclosure, rather than all embodiments. Based on the embodiments of the present disclosure, all other embodiments obtained by a person of ordinary skill in the art without creative work fall within the scope of protection of the present disclosure.

Figure 1:
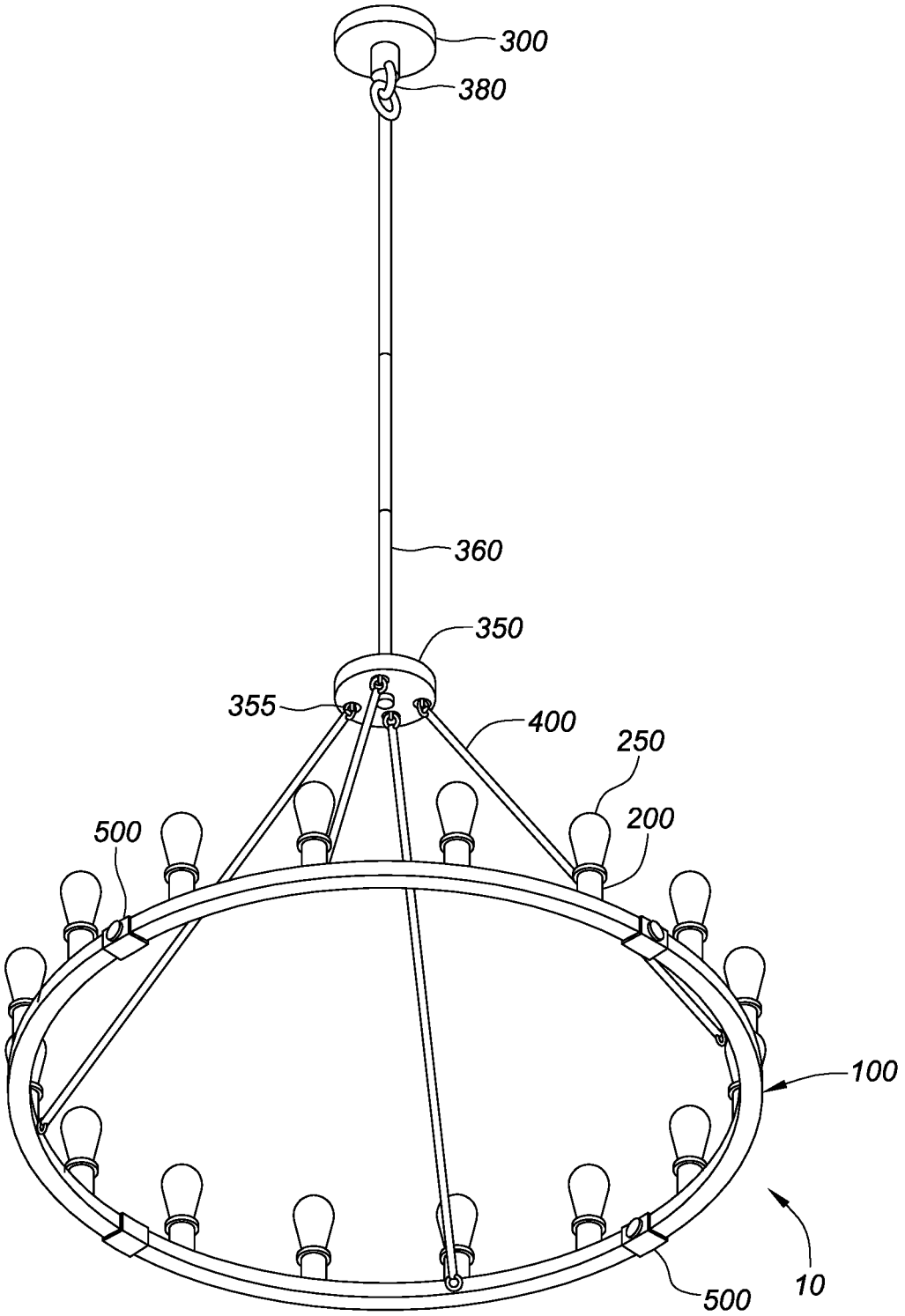
FIG. 1 is an isometric view of an embodiment of a luminaire.
Figure 2:
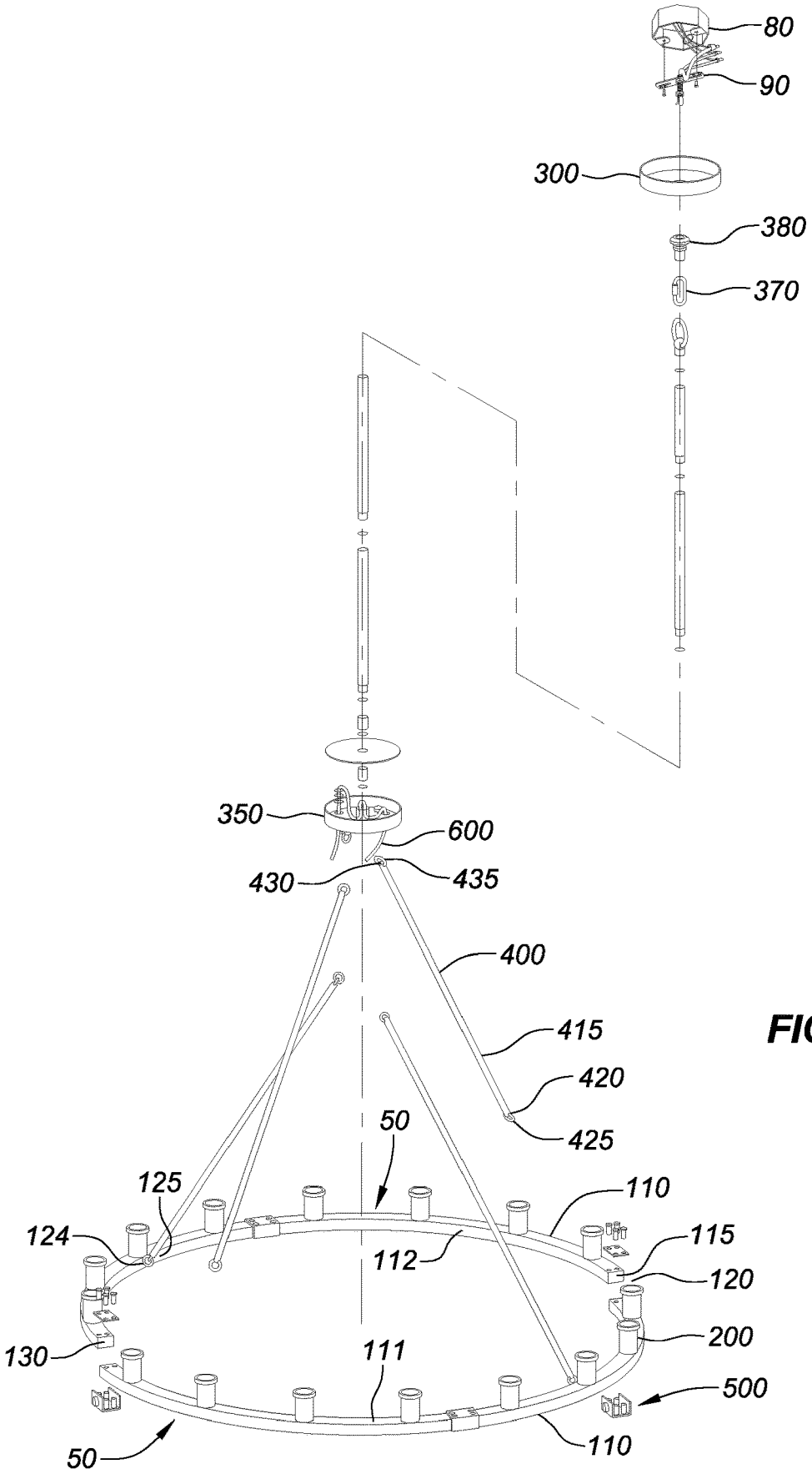
FIG. 2 is an exploded isometric view of the luminaire of FIG. 1.
Figure 3:
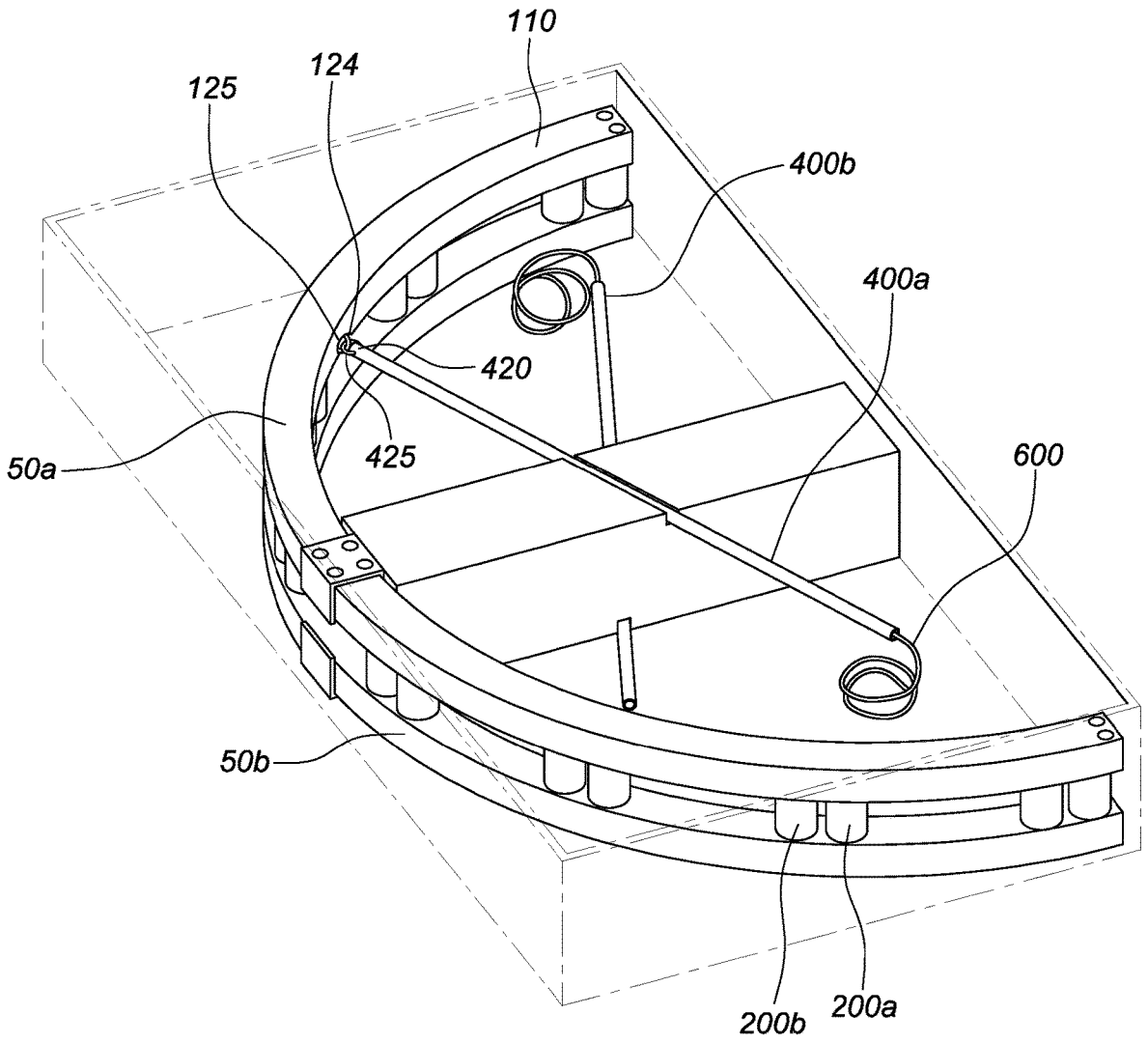
FIG. 3 is a view of partial assemblies of the luminaire of FIG. 1 knocked down and packaged within a box.

FIGS. 1 and 2 show a luminaire 10 in the form of a wagon wheel chandelier. Although a wagon wheel chandelier is shown, the embodiments of the present disclosure can apply to any type of luminaire that can be knocked down into partial assemblies and smaller components with reduced dimensions for convenient packaging and reduced shipping costs. When ready for assembly, the partial assemblies can be removed from the packaging and joined together to form the chandelier 10. The assembly process can be minimized by the sophistication of the design of the partial assemblies and the reduced number of assembly components. A partial assembly 50 is illustrated in FIG. 3, however, the components that make up a partial assembly can vary depending on the chandelier design and creativity in the arrangement of those components.

With reference to FIGS. 1 and 2, the chandelier 10, when fully assembled, comprises a frame 100, light mounts 200 or lamp sockets coupled to and supported by the frame 100, a ceiling canopy 300 enclosing a mounting bracket 90 for mounting the luminaire 10 to an electrical box 80 in the wall or ceiling, and connecting arms 400 coupling the frame 100 to the ceiling canopy 300. The light mount 200 is configured for holding lighting elements 250 such as light bulbs. In some embodiments, the light mount can itself be a lighting element or LED-based light engine. The chandelier 10 is configured to receive AC input power from an electrical box located on the wall or ceiling communicated by wires running through the ceiling canopy 300, connecting arms 400, frame 100, and to the light mounts 200 for providing power to illuminate the lighting elements 250. To increase the distance between the chandelier and the ceiling, the chandelier 10 may also include a lower canopy 350, one or more stems 360 connected in series from the lower canopy 350 to a rapid link 370, and a hanging loop ring 380 hanging below the ceiling canopy 300 to lower the chandelier 10 from the ceiling.

The frame 100 of the chandelier 10 can be an enclosed frame or an open frame and can be assembled from two or more frame parts 110. In the illustrated embodiment, the frame 100 is an enclosed circular frame formed from two semi-circular frame parts 110. The two semi-circular frame parts 110 are in the form of a rectangular pipe coupled end to end by linking structures 500. Although the frame 100 is shown as an enclosed circular frame, the overall shape of the frame 100 is not limited and can be any shape pieced together by the individual frame parts 110 including a square, rectangular, elliptical, and irregular shape. That is, the overall shape of the frame 100 can be controlled by the shape of the individual frame parts 110 that make up the frame 100.

Each frame part 110 can be a hollow structure having a channel or raceway 115 extending from one open end 120 to the other open end 130. The cross sectional profile of the frame part 110 is shown as having a rectangular shape with a rectangular channel, but can be any shape such as a circular and square shape. The channel 115 of the frame part 110 is preferably large enough for accommodating a set of wires 600 for each light mount 200 mounted directly or indirectly to a first surface 111 (e.g., top surface or bottom surface) of the frame part 110. The wires can be arranged such that each light mount 200 on the frame part 110 is connected in parallel so that if one lighting element 250 burns out, the other lighting elements 250 remain on. The frame part 110 can be made of a durable material such as metal, wood, or plastic. In the illustrated embodiment, the frame part 110 is a metal, rectangular pipe formed into a semi-circular shape.

One or more attachment devices 124 for connecting with the connecting arms 400 can be arranged along a second surface 112 (e.g., inner side surface) different from the first surface 111 of the frame part 110. The attachment device can also be on the same side or surface as the light mount 200. In the illustrated embodiment, the attachment device 124 is shown as a hook such as an eyelet hook or open hook for coupling with a connecting device of the connecting arm 400 as discussed in further detail below. The connection between the connecting arms and the frame part is not limited and can be by other means such as a ball or socket mechanism. The frame part 110 also has one or more holes 125 located adjacent to the attachment devices 124. The holes communicate with the channel 115 of the frame part 110 so that the wires 600 from the connecting arm 400 can pass through into the channel 115 of the frame part 110 and to the one or more light mounts 200.

Each connecting arm 400 of the chandelier 10 can be a hollow structure having a channel 415 running from one open end 420 to the other open end 430. Although the connecting arm 200 is shown as a one-piece pipe-like structure, the shape and design of the connecting arm 400 is not limited and can be any shape or design such as a hollow structure with curves or an assembly of more than one component. The channel 415 of the connecting arm 400 can be large enough for accommodating a set of wires 600 for at least one of the light mounts 200 coupled to the frame part 110. In some embodiments, only one connecting arm 400 feeds all the wires 600 to all the light mounts 200 connected to the frame part 110. The connecting arms 400 can be made of a durable material such as metal, wood, or plastic. The connecting arm 400 can have a first connecting device 425 near a first end 420 for coupling with the attachment device 124 of the frame part 110, and a second connecting device 435 near a second end 430 for coupling with a linking structure 355 such as a hook on the lower canopy 350, or a linking structure of the ceiling canopy 300, if no lower canopy 350 is present. The wires 600 extending out from the connecting arm 400 are fed through the adjacent holes 125 of the frame part 110 to connect with the light mounts 200.

When coupled together, the connecting arm 400 of the chandelier 10 is rotatably coupled to the frame part 110 to allow the connecting arms 400 to fold within an interior space of the frame arm to form a compact structure for convenient packaging, as shown in FIG. 3. In some embodiments, the connecting arms 400 are not yet coupled to the frame part 110 during shipping, but still somewhat coupled together by the wires passing through the channels 415, 115 of the connecting arm 400 and the frame part 110. Although open loop and closed loop (eyelet) hooks are shown and described in the present disclosure, any other type of connecting mechanisms can be used to achieve similar results, namely allowing the connecting arm 400 to rotatably couple with the frame part 110.

FIG. 3 shows two partial assemblies 50*s*, 50*b* of the chandelier 10 stacked on top of one another with the connecting arms 400*a*, 400*b* folded to fit into a compact package (e.g., a box). The partial assemblies and components that make up the chandelier 10 has a total volume less than a volume of the chandelier 10 fully assembled. A partial assembly 50 can comprise of a variety of components assembled together and packaged for shipment to the place of assembly. The partial assembly 50 can each comprise a frame part 110, a connecting arm, one or more light mounts 200, and wiring 400. In the illustrated embodiment, each partial assembly 50*a*, 50*b* comprises a semi-circular frame part 110, one connecting arm 400*a*, 400*b* rotatably fixed to the frame part 110 at an attachment device 125 from an inner surface of the frame part 110, eight light mounts 200*a*, 200*b* fixed on another surface of the frame part 110, and eight set of wires 600 for each light mount 20. All eight sets of wires extend through the connecting arm 400 to feed the light mounts 200 for each partial assembly 50*a*, 50*b*. The partial assembly 50*a* of the luminaire 10 together with another partial assembly 50*b* of the luminaire can be assembled together at the ends of the frame parts 110 by a linking structure 500.

Figure 4:
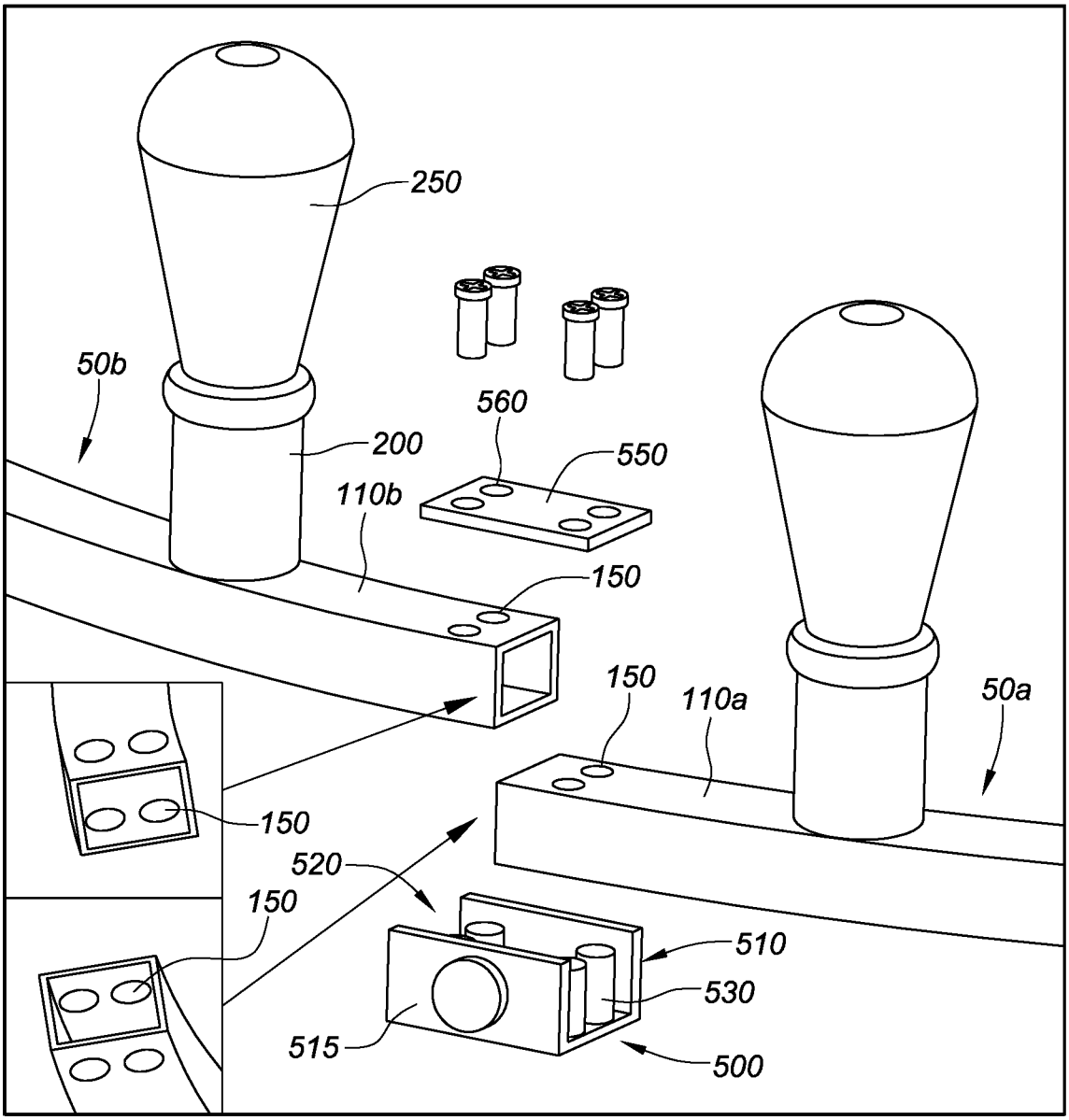
FIG. 4 is an enlarged partial view of the connection between a linking mechanism and two partial assemblies.

With reference to FIG. 4, the linking structure 500 can be used to attach the two or more frame parts 110*a*, 110*b* together. Each frame part 110*a*, 110*b* comprises a pair of through holes 150 provided at opposite ends 120, 130 of the frame part 110. The linking structure 500 comprises a C-shaped housing 510 having a channel 520 large enough to at least partially cover three surfaces at the ends 120, 130 of the frame part 110*s*, 110*b*. That is, the housing comprises a base and two sidewalls 515 extending perpendicularly from opposite sides of the base forming a C-shaped housing. The linking structure also comprises two pairs of cylindrical bosses 530 extending perpendicularly to the base. Each pair of bosses 530 is extendable through the pair of through holes 150 at the ends 120, 130 of the frame part 110 to fix one frame part 110*a* to another frame part 110*b*. Each boss 530 has a tapped hole for receiving a threaded fastener. A flat cover 550 with two pairs of through holes 560 and having a length similar to the length of the housing 510 and a width approximately the same width as the channel 520 of the housing 510 can be placed within the housing 510 atop a surface of the two frame parts 110*a*, 110*b*. Fasteners can extend through the through holes 560 of the flat cover 550 and threadedly engage the tapped holes of the bosses 530 to fix the flat cover 500 to the housing 510 and the frame parts 110*a*, 110*b*, thereby fixing the ends of the frame parts 110*a*, 110*b* and accordingly, the two partial assemblies 50*a*, 50*b* together. The design of the linking structure is not limited and can be any mechanism or device used to join two components together. Moreover, the linking structure can be a part of or fixed to the frame part 110, such as one end of one frame part 110 sleeved over another end of the frame part 110.

During assembly, the connecting devices of the second ends 430 of the connecting arms 400 can be attached to the canopy 300, 350 by hooks. The sets of wires 600 extending out the connecting arms from the second end 430 can pass through a central hole in the canopy 300, 350 for electrically connecting to the electrical box to supply power to the light mounts 200 for the lighting elements 250.

The various technical features in the above-mentioned embodiments can be arbitrarily combined. To simplify the description, all possible combinations of the technical features in the above-mentioned embodiments are not described herein. However, as long as there are no contradictions in the combinations of these technical features, all the combinations should be considered within the scope of the present disclosure.

The above-mentioned embodiments are merely several exemplary embodiments of the present disclosure, and their descriptions are more specific and detailed, but they should not be understood as limiting the scope of the present disclosure. It should be noted that, those skilled in the art can make various modifications and improvements without departing from the concept of the present disclosure, and these modifications and improvements all fall within the protection scope of the present disclosure. Therefore, the protection scope of the present disclosure shall be subject to the appended claims.

What is claimed is:

1. A chandelier, comprising:

a plurality of partial assemblies, each partial assembly comprising:

a frame part having a channel therein;

a light mount fixed to the frame part and configured for holding a lighting element;

a connecting arm rotatably coupled to the frame part and having a channel therein; and wiring electrically connected to the light mount and extending from the light mount through the channels of the frame part and the connecting arm; and a linking structure spaced away from the light mount along the frame part and configured for connecting opposite ends of the frame part of one partial assembly each to an end of the frame part of another partial assembly.

2. The chandelier of claim 1, wherein the linking structure is fixed at an end of the frame part of at least one of the partial assemblies.

3. The chandelier of claim 1, wherein the linking structure comprises a housing having a pair of cylindrical bosses and a threaded hole at an end of each cylindrical bosses, the cylindrical bosses extending through a through hole at each end of the frame part, and a cover having a pair of through holes corresponding to the threaded holes of the cylindrical protrusions.

4. The chandelier of claim 3, wherein the housing is C-shaped and covering, at least partially, three sides of the ends of two frame parts.

5. The chandelier of claim 4, wherein the cover is a flat plate covering a side of the ends of the two frame parts, and fasteners extend through the through holes of the cover to fix the cover to the housing and secure the frame part of one partial assembly to the frame part of another partial assembly.

6. The chandelier of claim 1, further comprising a canopy, wherein a free end of the connecting arm is coupled to the canopy.

7. The chandelier of claim 1, wherein the frame part has a semi-circular shape and the connecting arm is rotatably movable inside a perimeter of the frame part.

8. The chandelier of claim 1, wherein the frame part has an attachment device mounted to a surface of the frame part and a through hole communicating with the channel of the frame part, the through hole being adjacent to the attachment device and configured for providing access for wires to the channel.

9. The chandelier of claim 8, wherein the connecting arm has a connecting device at a first end of the connecting arm, the connecting device is engageable with the attachment device to rotatably couple the connecting arm to the frame part.

10. The chandelier of claim 9, wherein the connecting device is fixedly engaged with the attachment device.

11. The chandelier of claim 10, wherein the connecting device and the attachment device are hooks.

12. A method of packaging a chandelier into a box having a volume smaller than a volume of the chandelier, the chandelier being separable into a plurality of partial assemblies and at least one linking structure, each partial assembly comprising a frame element, a light mount coupled on the frame element, and a connecting arm rotatably coupled to the frame element, the at least one linking structure being configured for connecting opposite ends of the frame element of one partial assembly each to an end of the frame element of another partial assembly, the method comprising:

collapsing each of the partial assemblies of the chandelier by rotating the connecting arm towards an interior of the frame element; and stacking one partial assembly atop another partial assembly.

13. The method of claim 12, wherein the at least one linking structure connects an end of the frame element spaced away from the light mount along the frame part.

14. The method of claim 13, wherein the frame element has an enclosed channel for wires to pass therethrough.

15. The method of claim 13, wherein the at least one linking structure comprises a housing having a pair of cylindrical bosses and a threaded hole at an end of each cylindrical bosses, the cylindrical bosses extending through a through hole at each end of the frame part, and a cover having a pair of through holes corresponding to the threaded holes of the cylindrical protrusions.

16. The method of claim 15, wherein the housing is C-shaped and covering, at least partially, three sides of the ends of two frame parts.

17. The method of claim 16, wherein the cover is a flat plate covering a side of the ends of the two frame element, and fasteners extend through the through holes of the cover to fix the cover to the housing and secure the frame element of one partial assembly to the frame element of another partial assembly.

18. The method of claim 13, wherein a free end of the connecting arm is coupled to a canopy.

19. The method of claim 13, wherein the frame part has a semi-circular shape and the connecting arm is rotatably movable inside a perimeter of the frame part.

20. The method of claim 13, wherein an attachment device is mounted to a surface of the frame element and a through hole communicating with the channel of the frame element, the through hole being adjacent to the attachment device and configured for providing access for wires to the channel.

* * * * *